US009376179B2

(12) United States Patent
Jordan

(10) Patent No.: US 9,376,179 B2
(45) Date of Patent: Jun. 28, 2016

(54) WATERCRAFT FLOATING PORT LIFT SYSTEM

(71) Applicant: David Austin Jordan, Blounts Creek, NC (US)

(72) Inventor: David Austin Jordan, Blounts Creek, NC (US)

( * ) Notice: Subject to any disclaimer, the term of this patent is extended or adjusted under 35 U.S.C. 154(b) by 0 days.

(21) Appl. No.: 14/628,337

(22) Filed: Feb. 23, 2015

(65) Prior Publication Data

US 2015/0239535 A1 Aug. 27, 2015

Related U.S. Application Data

(60) Provisional application No. 61/942,789, filed on Feb. 21, 2014.

(51) Int. Cl.

| | |
|---|---|
| ***B63C 3/06*** | (2006.01) |
| ***B63C 1/02*** | (2006.01) |
| ***B63C 1/04*** | (2006.01) |

(52) U.S. Cl.

CPC ... *B63C 3/06* (2013.01); *B63C 1/02* (2013.01); *B63C 1/04* (2013.01)

(58) Field of Classification Search

CPC ..... B63C 1/02; B63C 3/06; B63C 7/00; B63C 15/00; B63B 35/00; B63B 35/40

USPC ..... 114/44, 45, 48, 51; 405/3, 7

See application file for complete search history.

(56) References Cited

U.S. PATENT DOCUMENTS

| | | | | |
|---|---|---|---|---|
| 4,641,595 A * | 2/1987 | Pritchett | B63C 3/06 | 114/44 |
| 5,795,098 A * | 8/1998 | Rueckert | B63C 1/02 | 114/48 |
| 6,923,132 B1 * | 8/2005 | McKenzie | B63B 35/40 | 114/44 |
| 7,481,175 B2 * | 1/2009 | Dickman | B63C 1/02 | 114/263 |

* cited by examiner

*Primary Examiner* — Lars A Olson

(74) *Attorney, Agent, or Firm* — Ward and Smith, P.A.; Ryan K. Simmons

(57) ABSTRACT

A watercraft floating port lift system is disclosed. In some embodiments, the lift system may include a platform frame, one or more floating ports coupled to the platform frame, and a lift mechanism. The lift system may be operatively coupled to and capable of lifting the one or more floating ports, platform frame, and any watercraft that may be positioned thereon out of a body of water and maintain the watercraft, ports, and platform frame above the water for an extended storage period. The lift system may also be capable of subsequently lowering the watercraft, one or more floating ports, and platform frame back to the body of water in a controlled manner, thereby enabling a user to launch and subsequently recover a watercraft from the body of water.

15 Claims, 4 Drawing Sheets

WATERCRAFT FLOATING PORT LIFT SYSTEM

CROSS REFERENCE TO RELATED APPLICATION

This application is related to and claims the priority of U.S. Provisional Patent Application Ser. No. 61/942,789, filed Feb. 21, 2014, the disclosure of which is incorporated by reference it its entirety.

TECHNICAL FIELD

The present invention relates generally to combination floating docks and lift systems for watercraft. More specifically, the present invention relates to a lift system that allows for use of a floating watercraft port in areas that may experience rough water that would otherwise prohibit use of a floating watercraft port.

BACKGROUND

Typically, owners and users of watercraft, including fishing boats, recreational power boats, personal watercraft (PWC), and the like, require some means for storing and/or securing such watercraft to a dock or other waterside structure. In many circumstances, it is advantageous to employ floating, drive on ports such as the EZ-Port® by EZ Dock® or the Safe Haven™ by Southeaster Dock and Platform, just to name a few. These floating ports offer many advantages over alternative securing/storage mechanisms (e.g., tying a watercraft to a dock or trailering the watercraft out of the water with a vehicle) including the ability to store the watercraft out of the water, the ability to drive the watercraft onto the port and step off onto a solid surface without the boat moving relative to that surface, and the ability to accommodate such a port in areas subject to changing water levels (e.g., tidal areas).

Unfortunately, floating ports such as those discussed above are limited to use in relatively calm water. In fact, use of such floating port devices in areas subject to rough water, such as on large bodies of water, areas exposed to extreme weather, or high traffic areas, is typically prohibited by floating port manufacturers because the floating ports cannot withstand the stresses associated with use in rough water areas. Accordingly, those who need to secure/store watercraft on waterways subject to rough water conditions are generally precluded from making use of floating ports.

Traditionally, those who desire to store/secure their watercraft in rough water areas may utilize a boat lift mechanism. Such boat lift mechanisms generally employ liftable bunks configured to correspond to the hull of the watercraft, much in the same way bunks are employed on corresponding boat trailers. The bunks are configured to be lowered beneath the waterline and the watercraft is then positioned above the bunks. As the bunks are raised, they receive the watercraft's hull and are then lifted further, thereby raising the bunks and the watercraft above the waterline to a position high enough to avoid any rough water, and when combined with a shelter, any undesirable weather that may occur. Consequently, the bunks must generally be deployed below the waterline in order to allow the watercraft to be positioned above them—a location that makes use of such a device difficult because the bunks are obscured or impossible to see. Moreover, a user of such a lift must generally park the boat and, undesirably, step out of the boat onto the dock in conditions where the boat may be moving relative to the dock.

Accordingly, it is desirable to provide a solution for watercraft owners desiring the advantages of a floating port but who may be located in areas where rough water precludes such use. Specifically, it would be desirable to have a system that includes a floating port that allows a watercraft owner to take advantage of the benefits associated therewith, that is also configured to be lifted out of the water, thereby enabling the watercraft owner to use the floating port in areas subject to rough water.

BRIEF DESCRIPTION OF THE INVENTION

A floating port system is disclosed. In some embodiments, the floating port lift system includes a platform frame, one or more floating ports coupled to the platform frame, and a lift mechanism operatively connected to the platform frame. In preferred embodiments, the one or more floating ports are each configured to receive a watercraft. The platform frame may further include securing mechanisms that couple the platform frame to the one or more floating ports. The securing mechanisms may include one or more alignment posts coupled to the platform frame and an alignment hole coupled to each of the one or more floating ports. Such alignment posts may be aligned with an associated alignment hole and sized to pass through the alignment hole on each of the one or more floating ports. Additionally, the alignment posts may be made of a material capable of withstanding lateral forces imparted upon it by the alignment hole coupled to each of the one or more floating ports, thereby preventing substantial lateral movement of the one or more floating ports relative to the platform frame. The alignment posts may also have a diameter less than a diameter of the alignment holes, thereby enabling the one or more floating ports to move vertically relative to the platform frame. In one example, the alignment posts are made from polyvinyl chloride (PVC) pipe. The alignment posts may also be made of other appropriate materials, including stainless steel, aluminum, or other marine grade material.

In some embodiments, the lift mechanism may include one or more motors and one or more cables, where the one or more cables are coupled to the platform frame. Generally, the lift mechanism is capable of lifting the platform frame, the one or more floating ports, and an associated watercraft positioned thereon. The lift mechanism is generally also capable of holding the platform frame, the one or more floating ports, and the associated watercraft positioned thereon in the air for an extended storage period.

The platform frame may include first and second side members, first and second end members, and one or more joists spanning between the first and second side members or between the first and second end members. In some embodiments, the one or more joists include two or more joists aligned substantially parallel to one another and evenly spaced apart. In certain preferred embodiments, the first and second side members and the first and second end members are arranged in a substantially rectangular configuration. The platform frame may further be arranged such that the first and second side members and the first and second end members comprise a top area that extends above a top edge of the one or more joists, thereby forming a nest area within the platform frame. The nest area may be configured to include a size and shape substantially similar to a base portion of the one or more floating ports.

DETAILED DESCRIPTION OF THE INVENTION

The presently disclosed subject matter now will be described more fully hereinafter with reference to the accompanying Figures/Examples, in which some, but not all embodiments of the presently disclosed subject matter are shown. Like numbers refer to like elements throughout. The presently disclosed subject matter may be embodied in many different forms and should not be construed as limited to the embodiments set forth herein; rather, these embodiments are provided so that this disclosure will satisfy applicable legal requirements. Indeed, many modifications and other embodiments of the presently disclosed subject matter set forth herein will come to mind to one skilled in the art to which the presently disclosed subject matter pertains having the benefit of the teachings presented in the foregoing descriptions and the associated Figures/Examples. Therefore, it is to be understood that the presently disclosed subject matter is not to be limited to the specific embodiments disclosed and that modifications and other embodiments are intended to be included within the scope of the appended claims.

Figure 1:
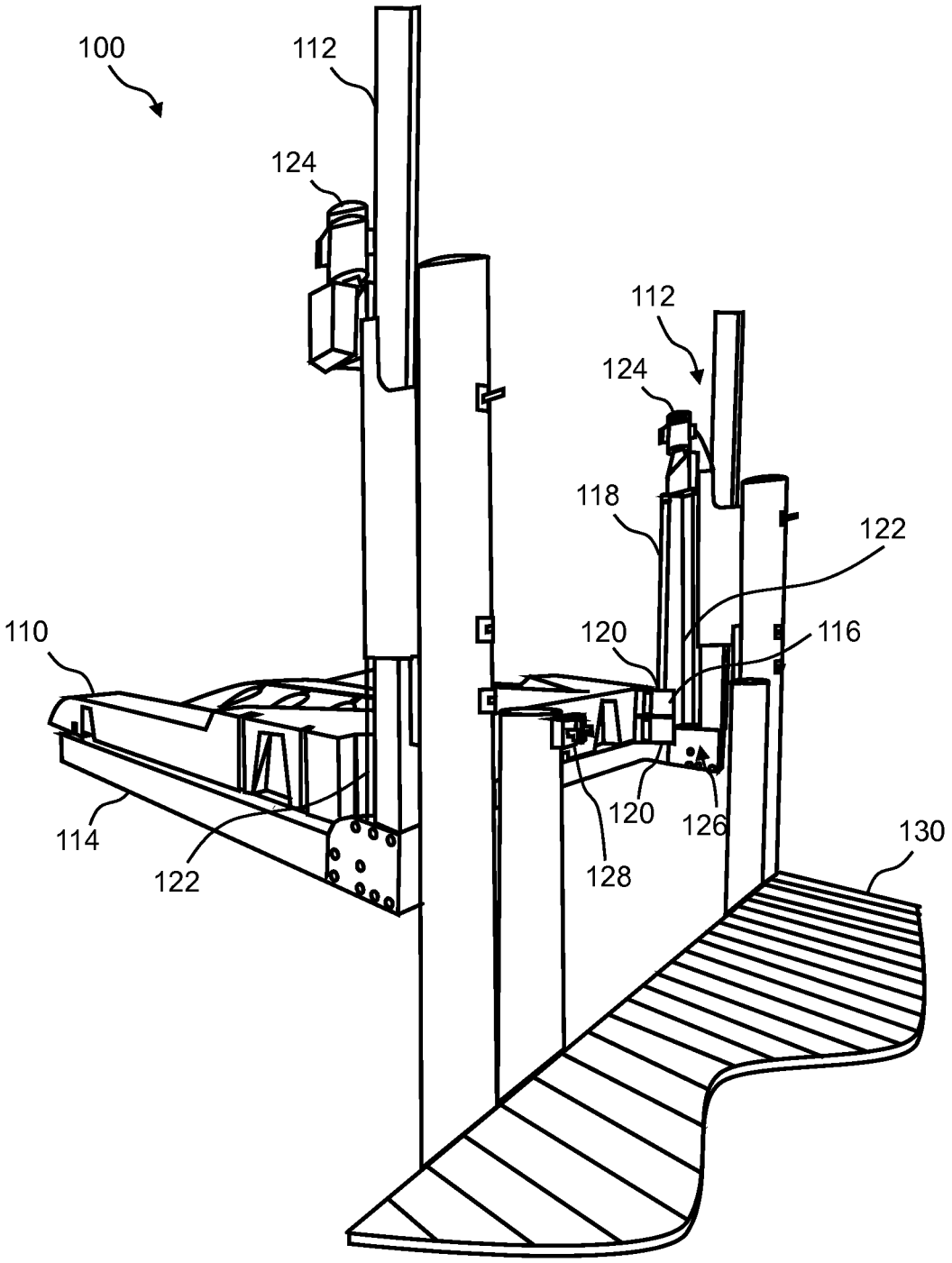
FIG. 1 illustrates a side perspective view of the floating port lift system in accordance with certain embodiments of the present invention.
Figure 2:
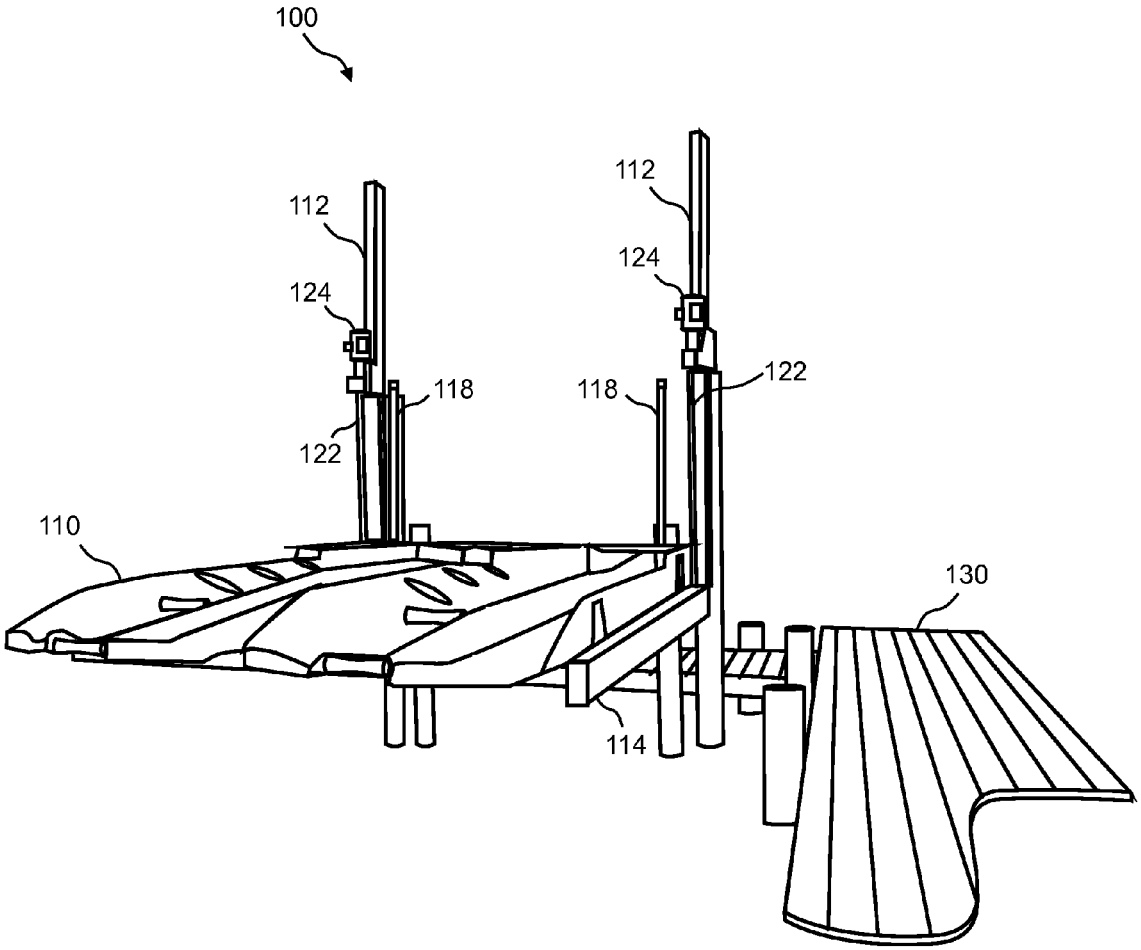
FIG. 2 illustrates a front perspective view of the floating port lift system in accordance with certain embodiments of the present invention.
Figure 3:
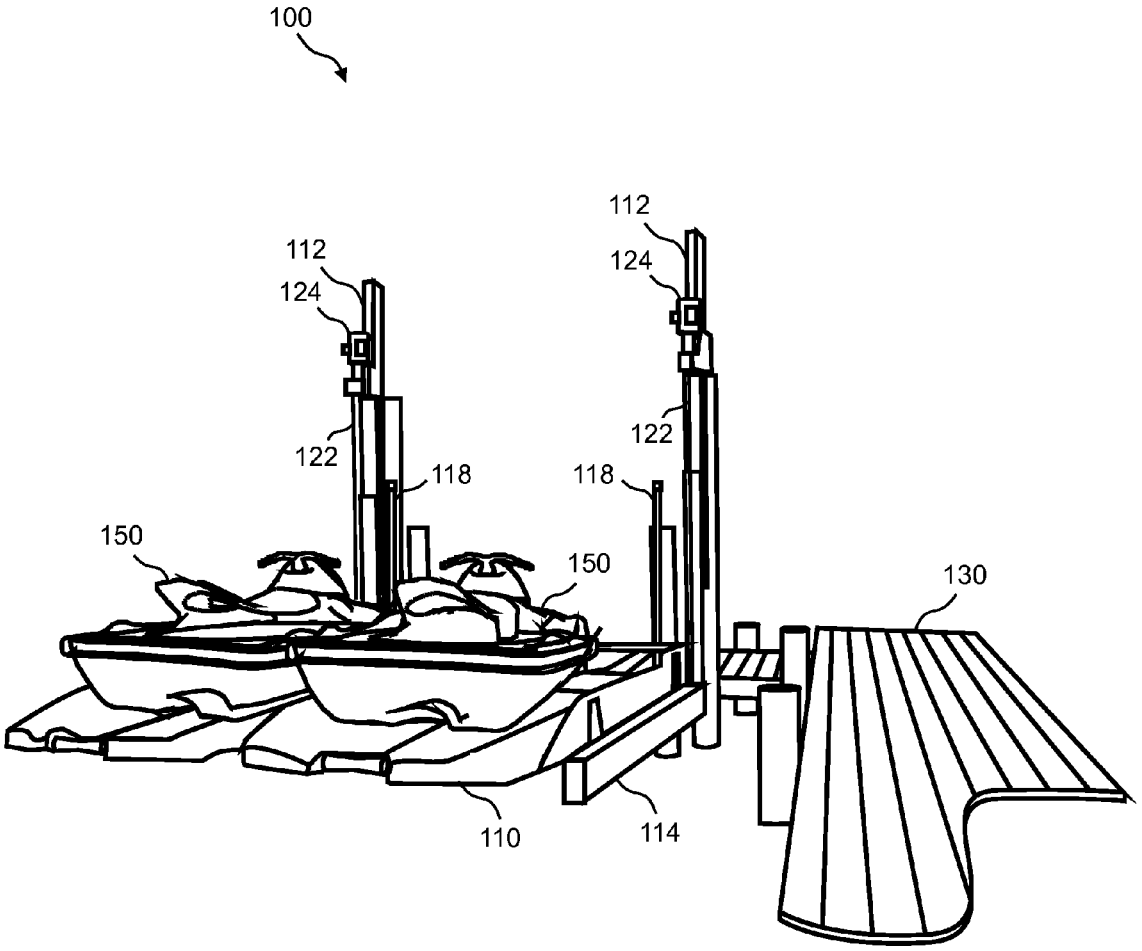
FIG. 3 illustrates yet another front perspective view of the floating port lift system, including exemplary watercraft positioned thereon, in accordance with certain embodiments of the present invention.

In accordance with one embodiment of the present invention, a watercraft floating port lift system 100 is provided generally in accordance with the features identified in FIGS. 1, 2, and 3, each of which form a part of this description and are incorporated herein by reference. The floating port lift system generally includes one or more floating ports 110, a platform frame 114, and a lift mechanism 112. The one or more floating ports 110 may be configured to receive any number of watercraft types (e.g. watercraft 150), including fishing boats, recreational power boats, non-motorized watercraft, PWCs, or any combination thereof. Additionally, the floating ports 110 may be of the types discussed above, or may be specially designed for use with the system described herein. Moreover, where more than one floating port 110 is desired (i.e. a system capable of lifting multiple watercraft 150 is desired), the one or more floating ports 110 may be combined such that multiple single watercraft floating ports 110 are coupled together to form one multi-vessel floating port, or alternatively, the floating port may be a single unit configured to receive multiple watercraft 150. The one or more floating ports may also include two or more floating ports 110 that are not directly coupled to one another, but are each coupled to the system 100 such that the system 100 may lift multiple watercrafts 150 on multiple floating ports 110.

Figure 4A:
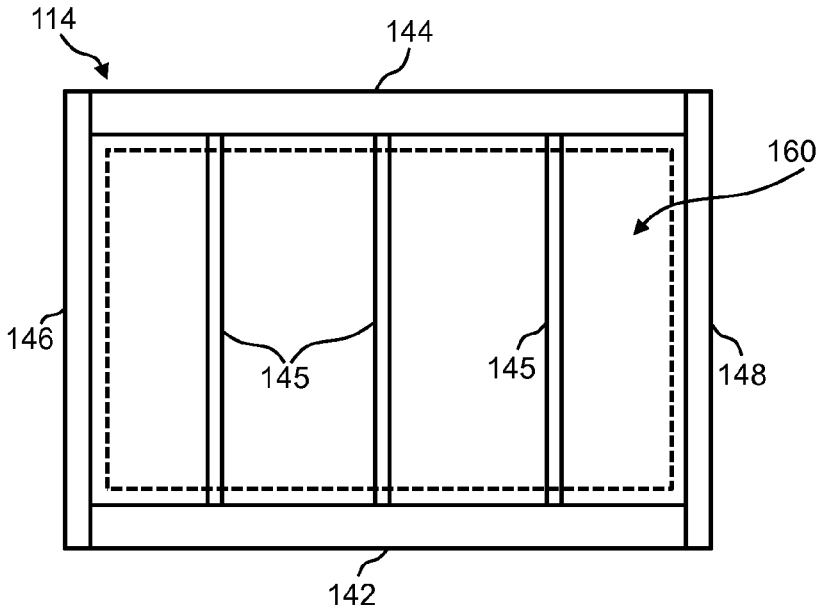
FIG. 4A illustrates a top view of the platform frame, in accordance with certain embodiments of the present invention.
Figure 4B:
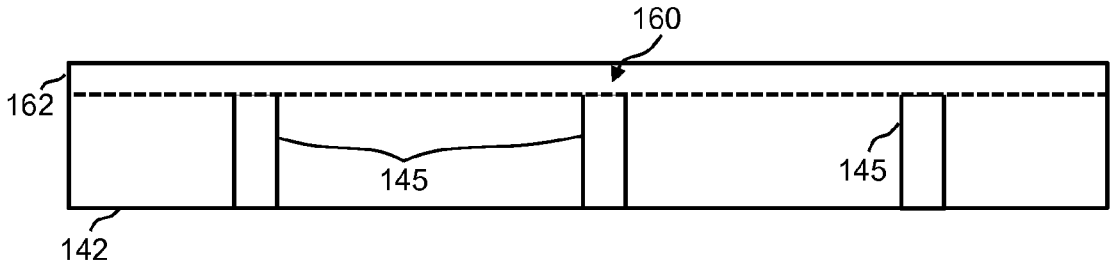
FIG. 4B illustrates a side view of the platform frame, in accordance with certain embodiments of the present invention.

The platform frame 114 may be any structure capable of being coupled to the one or more floating ports 110 and further capable of supporting both the one or more floating ports 110 and any watercraft 150 for which the floating ports 110 are configured to receive. By way of just one example, the platform frame 114 may be a rectangular joist system such as the system shown in FIG. 4A and FIG. 4B. In this example, the platform frame 114 may include a first side member 142 opposite a second side member 144 and a first end member 146 opposite a second end member 148. First and second side members (142, 144) and first and second end members (146, 148) may be coupled to one another such that they form substantially a rectangular outer frame structure. The rectangular outer frame structure may further include one or more joist members 145. Joist members 145 may span from the first side member 142 to the second side member 144, or alternatively from first end member 146 to second end member 148. Joist members 145 are preferably substantially parallel with one another and evenly spaced apart. The platform frame 114 may also be of any other shape or configuration desired, e.g., substantially square, triangular, etc.

The platform frame 114 and one or more floating ports 110 may be coupled together in any manner desirable. For example, in some embodiments, the one or more floating ports 110 may be secured to the platform frame 114 by way of one or more securing mechanisms, which may include, for example, alignment features 116. Securing mechanisms may be desirable in order to prevent, for example, high winds or some other force (e.g. wave, watercraft, person, etc.) from pushing the floating port(s) 110 off of their position on or above the platform frame 114. The securing mechanisms may couple the floating ports 110 directly to the platform frame 114 (i.e. the frame and ports become a single unit) or may secure the floating ports 110 to the platform frame 114 such that the ports are free to move vertically relative to the frame, but not substantially in a lateral manner.

The one or more securing mechanisms may be any mechanism that mechanically couples the one or more floating ports 110 to the platform frame 114, including for example, one, or any combination of alignment post/hole system, straps, screws, bolts, ropes, chains, clips, or the like.

In some embodiments, the platform frame 114 may include one or more alignment features 116 configured to ensure that the floating ports 110 maintain a desirable position relative to the platform frame 114. The alignment features 116 may further act as the securing mechanisms securing the floating ports 110 to the platform frame. By way of just one example, the platform frame 114 may include one or more alignment posts 118 that are secured to and extend up from the platform frame 114. The alignment posts 118 may pass through, for example, one or more alignment holes 120 on the floating ports. Accordingly, in some embodiments, the floating ports may be secured to the platform frame 114 via the alignment hole 120 which is configured to receive the alignment post 118 and prevent substantial lateral movement of the floating ports 110 relative to the platform frame 114, while allowing vertical movement. Moreover, this configuration allows the platform frame 114 to be lowered substantially below the waterline while the floating ports 110 to remain floating on the surface of the water. The alignment posts 118, however, may be configured to remain extending through the alignment holes 120 of the floating ports 110, thereby preventing the floating ports 110 from floating away or otherwise moving along the waterline in an undesirable manner.

In certain other embodiments, the first and second side members (142, 144) and first and second end members (146, 148) may be configured such that a top area 162 of each of the first and second side members (142, 144) and first and second end members (146, 148) extends above the one or more joist members 145, thereby creating a nest area 160 into which the floating ports 110 may sit upon the platform frame 114. In such embodiments, the floating ports 110 may be configured such that a bottom portion of the floating ports 110 substantially corresponds in size and shape to the size and shape of the nest area 160. By virtue of their corresponding shape and/or positioning within the nest area 160 formed in the platform frame 114 when raised, the floating ports 110, in this configuration, may not require securing mechanisms in order to be adequately secured to the platform frame 114. Of course, if desired, securing mechanisms may be used in combination with the nest configuration.

When lifting of the floating ports 110 and/or any watercraft 150 thereon is desired, the alignment posts 118 and alignment holes 120 ensure that the floating ports 110 remain desirably positioned above the platform frame 114 as the platform frame 114 is raised such that the floating ports 110 are properly received by the platform frame 114 (e.g., in the nest area 160) as it is raised, thereby facilitating proper positioning for continued lifting to a desired height above the waterline once the platform frame 114 engages the floating ports 110.

To facilitate the lifting, the watercraft floating port lift system 100 may further include a lift mechanism 112. The lift mechanism 112 may include winch, hoist, or other suitable lift system, wherein the lift mechanism 112 may also utilize a cable, rope, chain, similar mechanism, or combination thereof coupled to the platform frame 114. The lift mechanism 112 may further include a pulley system 126 if desired. Furthermore, the lift mechanism 112 may be hand operated or be powered by a motor (e.g. motor 124). In some embodiments, the motor 124 may be an electric motor (e.g., a 120 volt motor), which may be coupled to a switch 128 and configured to be powered by a standard household outlet, for example, a 120 volt AC household outlet, or hardwired directly to an electrical supply/source. The motor may, alternatively, be powered by a 12 volt motor, or any other suitable voltage and/or mechanism (e.g. battery and/or solar power).

In some embodiments, the watercraft floating port lift system 100 may be installed on or within a boat house, boat shed, or any other waterside dock or pier type structure (e.g. waterside structure 130). Generally, the lift mechanism 112 is preferably configured to lift the platform frame 114, floating ports 110, and/or any watercraft 150 positioned thereon out of the water, thereby protecting the watercraft 150 and floating ports 110 from rough water and/or undesirable weather. Accordingly, the lift mechanism 112 is preferably configured not only to lift the platform frame 114 and floating ports 110 and/or any watercraft 150 positioned thereon out of the water, but also enable such components to remain suspended above the waterline for extended periods of desired storage.

The lift mechanism 112 may include any mechanism capable of lifting the platform frame 114, the one or more floating ports 110, and any watercraft 150 that may be desirably positioned thereon. Such mechanisms include cantilever style lifts installed on one or more pilings, four piling lift mechanisms, or hydraulic style lift mechanisms, any of which may be associated with a waterside structure 130 like those described above. In certain embodiments, the lift mechanism 112 may include a winch or motor 124 coupled to a cable spool and cable 122, wherein the cable 122 is coupled either directly to the platform frame 114 or more indirectly by way of the pulley system 126. Note that some embodiments of the lift mechanism may employ, for example, multiple motors, multiple winches, and/or multiple cables as desired.

By way of one example, when the switch 128 is activated, thereby allowing power to flow to the motor 124, the motor 124 drives the cable spool which either coils or uncoils the cable 122 as desired so as to raise or lower the platform frame 114, floating ports 110, and/or any watercraft 150 positioned thereon. Operation may begin by starting with the platform frame 114 and floating ports 110 in a lowered position, whereby the platform frame 114 and floating ports 110 are positioned such that the floating ports 110 are substantially positioned as they would be if installed to float on the water as designed. From this lowered position, one or more watercraft 150 (e.g. one or more personal watercraft) may be driven onto the floating ports as designed. The watercraft operator may then exit the watercraft 150 and optionally step onto the floating port 110 before moving to a dock or other structure to which the system is installed (e.g. waterside structure 130).

Thereafter, a user may operate the switch 128 to power the one or more motors 124 so as to drive the cable spool, wherein the cable spool coils the cable 122. As the cable 122 is coiled, the platform frame 114 is raised. Once the platform frame 114 contacts the floating ports 110 (in embodiments where the floating ports 110 are configured to move vertically relative to the platform frame 114), the ports 110 being properly positioned relative to the platform frame 114 by virtue of, for example, the alignment features 116, the floating port 110 may be received by the platform frame 114 and both the platform frame 114 and floating ports 110, including any watercraft 150 positioned thereon, may continue to be lifted. Operation continues until the floating ports 110 and/or watercraft 150 achieve a desired height above the waterline. Thereafter, the system is capable of maintaining the watercraft 150, one or more floating ports 110, and platform frame 114 at the desired height above the waterline for an extended storage period (e.g. several hours, several days, several months, etc.).

When desired, the process may be reversed to return the floating ports 110 and/or watercraft 150 to a point substantially near the water. Specifically, power may be delivered to the motor 124 such that the motor 124 drives the cable spool, thereby uncoiling the cable 122 such that the platform frame 114, floating ports 110, and/or any watercraft 150 positioned thereon are lowered towards the waterline. The platform frame 114 may be lowered until the floating ports 110 reach a desired point substantially at or near the waterline. At that point, the platform frame 114 may be optionally lowered further with the floating ports 110 remaining afloat on the surface of the water (in embodiments where the floating ports 110 are configured to freely move vertically relative to the platform frame 114), or alternatively the platform frame 114 may be positioned such that the floating ports 110 remain generally coupled to the platform frame 114 (either by additional securing mechanisms or by gravity alone), but in a manner that allows the floating ports 110 to be positioned such that watercraft 150 may be driven onto and off of the ports as designed.

Following long-standing patent law convention, the terms "a," "an," and "the" refer to "one or more" when used in this application, including the claims. Thus, for example, reference to "a subject" includes a plurality of subjects, unless the context clearly is to the contrary (e.g., a plurality of subjects), and so forth.

Throughout this specification and the claims, the terms "comprise," "comprises," and "comprising" are used in a non-exclusive sense, except where the context requires otherwise. Likewise, the term "include" and its grammatical variants are intended to be non-limiting, such that recitation of items in a list is not to the exclusion of other like items that can be substituted or added to the listed items.

For the purposes of this specification and appended claims, unless otherwise indicated, all numbers expressing amounts, sizes, dimensions, proportions, shapes, formulations, parameters, percentages, parameters, quantities, characteristics, and other numerical values used in the specification and claims, are to be understood as being modified in all instances by the term "about" even though the term "about" may not expressly appear with the value, amount or range. Accordingly, unless indicated to the contrary, the numerical parameters set forth in the following specification and attached claims are not and need not be exact, but may be approximate and/or larger or smaller as desired, reflecting tolerances, conversion factors, rounding off, measurement error and the like, and other factors known to those of skill in the art depending on the desired properties sought to be obtained by the presently disclosed subject matter. For example, the term "about," when referring to a value can be meant to encompass variations of, in some embodiments, ±100% in some embodiments ±50%, in some embodiments ±20%, in some embodiments ±10%, in some embodiments ±5%, in some embodiments ±1%, in some embodiments ±0.5%, and in some embodiments ±0.1% from the specified amount, as such variations are appropriate to perform the disclosed methods or employ the disclosed compositions.

Further, the term "about" when used in connection with one or more numbers or numerical ranges, should be understood to refer to all such numbers, including all numbers in a range and modifies that range by extending the boundaries above and below the numerical values set forth. The recitation of numerical ranges by endpoints includes all numbers, e.g., whole integers, including fractions thereof, subsumed within that range (for example, the recitation of 1 to 5 includes 1, 2, 3, 4, and 5, as well as fractions thereof, e.g., 1.5, 2.25, 3.75, 4.1, and the like) and any range within that range.

Although the foregoing subject matter has been described in some detail by way of illustration and example for purposes of clarity of understanding, it will be understood by those skilled in the art that certain changes and modifications can be practiced within the scope of the appended claims.

What is claimed is:

1. A watercraft floating port lift system, the system comprising:

a. a platform frame;

b. one or more floating ports coupled to the platform frame;

c. a lift mechanism operatively connected to the platform frame; and wherein, the platform frame is coupled to the one or more floating ports by one or more securing mechanisms, and wherein the securing mechanisms comprise one or more alignment posts coupled to the platform frame and an alignment hole coupled to each of the one or more floating ports, and further wherein the one or more alignment posts are aligned with an associated alignment hole and sized to pass through the associated alignment hole on each of the one or more floating ports.

2. The system of claim 1 wherein the one or more alignment posts comprise a diameter less than a diameter of the alignment holes, thereby enabling the one or more floating ports to move vertically relative to the platform frame.

3. The system of claim 1 wherein the one or more alignment posts comprise a material capable of withstanding lateral forces imparted upon it by the alignment hole coupled to each of the one or more floating ports, thereby preventing substantial lateral movement of the one or more floating ports relative to the platform frame.

4. The system of claim 3 wherein the material comprises one or more of polyvinyl chloride (PVC) pipe, stainless steel, aluminum, or other marine grade material.

5. The system of claim 1 wherein the one or more floating ports are coupled to the platform frame such that the one or more floating ports is capable of vertical movement relative to the platform frame and lateral movement of the one or more floating ports relative to the platform frame is substantially prevented.

6. The system of claim 1 wherein the lift mechanism comprises one or more motors and one or more cables, and further wherein the one or more cables are coupled to the platform frame.

7. The system of claim 1 wherein the lift mechanism is capable of lifting the platform frame, the one or more floating ports, and an associated watercraft positioned thereon.

8. The system of claim 7 wherein the lift mechanism is further capable of holding the platform frame, the one or more floating ports, and the associated watercraft positioned thereon in the air for an extended storage period.

9. The system of claim 1 wherein the platform frame comprises first and second side members and first and second end members.

10. The system of claim 9 wherein the first and second side members and the first and second end members are arranged in a substantially rectangular configuration.

11. The system of claim 9 wherein the platform frame further comprises one or more joists spanning between the first and second side members or the first and second end members.

12. The system of claim 11 wherein the one or more joists comprise two or more joists and the two or more joists are substantially parallel with one another and evenly spaced apart.

13. The system of claim 11 wherein the first and second side members and the first and second end members comprise a top area that extends above a top edge of the one or more joists, and is configured to form a nest area within the platform frame.

14. The system of claim 13 wherein the nest area comprises a size and shape substantially similar to a base portion of the one or more floating ports.

15. The system of claim 1 wherein the one or more floating ports are each configured to receive a watercraft.

* * * * *